US008407819B2

(12) United States Patent
Chen

(10) Patent No.: US 8,407,819 B2
(45) Date of Patent: Apr. 2, 2013

(54) NOSE-SHIELDING DEVICE FOR HELMET

(76) Inventor: Tsan-Jee Chen, Taipei (TW)

( * ) Notice: Subject to any disclaimer, the term of this patent is extended or adjusted under 35 U.S.C. 154(b) by 27 days.

(21) Appl. No.: 13/084,671

(22) Filed: Apr. 12, 2011

(65) Prior Publication Data

US 2012/0260407 A1 Oct. 18, 2012

(51) Int. Cl.
*A42B 1/08* (2006.01)

(52) U.S. Cl. ..... 2/424

(58) Field of Classification Search ..... 2/422, 424, 2/425, 171.3, 171.4, 436, 437, 9, 410
See application file for complete search history.

(56) References Cited

U.S. PATENT DOCUMENTS 3,311,922 A * 4/1967 Bezzerides ..... 2/8.1
5,797,146 A * 8/1998 Matich ..... 2/424
6,644,308 B2 * 11/2003 Kalhok et al. ..... 128/201.24
6,742,192 B1 * 6/2004 Song ..... 2/422

* cited by examiner

*Primary Examiner* — Tejash Patel
(74) *Attorney, Agent, or Firm* — Ming Chow; Sinorica, LLC

(57) ABSTRACT

A nose-shielding device comprises: a nose-shielding body, which has a nose-shielding surface and a positioning surface that are about perpendicular to each other, a nose-shielding portion being located around the central of the nose-shielding surface and protruded upward, a nose-shielding room being formed accordingly inside the nose-shielding portion, a nose-touching portion being formed at the bottom surface of the nose-shielding portion, an adjusting room being formed between the nose-touching portion and the bottom surface of the nose-shielding portion.

7 Claims, 7 Drawing Sheets

NOSE-SHIELDING DEVICE FOR HELMET

BACKGROUND OF THE INVENTION

1. Field of the Invention

The present invention generally relates to a nose-shielding device for helmet, more particularly to a nose-shielding device that is made integrally and combined in the internal of the helmet in order to avoid that the mask of the helmet is fogged while warm air happens.

2. Description of the Prior Art

Present anti-fogging device with snow helmet 1 in market is directly combined in a helmet, as shown in FIG. 1, which illustrates a schematic structural view of a prior anti-fogging device with snow helmet. The prior anti-fogging device with snow helmet 1 has a nose-shielding body 11, a protruding nose-shielding portion 12 with nose-shielding room is sewn at the central of the nose-shielding body 11, a vertical combining portion 13 combined with the internal of a helmet is sewn at the front edge of the nose-shielding body 11, an iron member 14 is sewn on the protruding nose-shielding portion 12, the inner side surfaces of the nose-shielding body 11 and the protruding nose-shielding portion 12 are both connected with a buffer foam strip 15 so as to let the nose of an operator be accommodated in the nose-shielding room of the protruding nose-shielding portion 12 while wearing the helmet, the iron member 14 on the protruding nose-shielding portion 12 is adjustable to fit the figures of different noses, additionally the front edge of the protruding nose-shielding portion 12 is connected with the vertical combining portion 13 via a Velcro 16, and to adjust the vertical positions of the Velcro 16 being on the vertical combining portion 13 is to adjust the heights of the protruding nose-shielding portion 12, so that it is to serve different heights of noses.

The nose-shielding body 11 can directly touch the face of the operator, and the nose-shielding room of the protruding nose-shielding portion 12 is able to accommodate the nose. Thus, the warm air discharged by the nose may goes up but be blocked by the anti-fogging device with snow helmet 1 so as to avoid that the mask of the helmet is nebulized. Hence the view of the operator is always clear.

However, prior anti-fogging device with snow helmet has such anti-fogging mask, but is still with some shortages listed below:

The prior art is manufactured by complicate procedures and assembled by several sets of components. To assemble such components shall be man-made with sewing, and it is to confuse the whole production procedures. Further, raw materials for components are not the same, then different costs as material, time, etc. are increased so as to not meet for economy. Moreover, some quality problems may definitely be caused by complicate product procedures.

Accordingly, to provide a nose-shielding device for helmet that is made integrally can overcome the complicate product procedures and save the costs of material, time, labor, etc. And it will be the best solution.

SUMMARY OF THE INVENTION

The main objective of the present invention is to provide the nose-shielding device for helmet, the nose-shielding device is made integrally, and the production process is simplified and without rework, thus cost, time and labor can then be saved, and other quality problems caused by the complicate manufacturing processes are reduced as well.

The other objective of the present invention is to provide the nose-shielding device for helmet, the nose-shielding device is made of rubber and plastic material as PU or silicone. Hence, the position of the nose-touching portion touching the bridge is completely sealed, so that the warm air discharged from the nose or mouth of the operator may not go up to the portions above the nose of the operator, and the mask of the helmet is not nebulized.

To approach aforesaid objectives, the nose-shielding device comprises: a nose-shielding body, which has a nose-shielding surface and a positioning surface that are about perpendicular to each other, a nose-shielding portion being located around the central of the nose-shielding surface and protruded upward, a nose-shielding room being formed accordingly inside the nose-shielding portion, a nose-touching portion being formed at the bottom surface of the nose-shielding portion, an adjusting room being formed between the nose-touching portion and the bottom surface of the nose-shielding portion.

Preferably, the nose-shielding body is made integrally.

Preferably, the each side surface of the nose-shielding portion has a groove in order to fit the each nosewing of the nose of an operator.

Preferably, the nose-shielding is made of rubber and plastic material.

Preferably, the positioning surface of the nose-shielding body has at least one positioning hole in order to let the nose-shielding body be combined inside the helmet and located below a mask.

Preferably, the other side edge, without the positioning surface, of the nose-shielding surface is elongated backward and bent inwardly to form a fold sheet, the fold sheet covers the nose-shielding portion, so that the bottom surface of the nose-shielding portion is formed the nose-touching portion.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
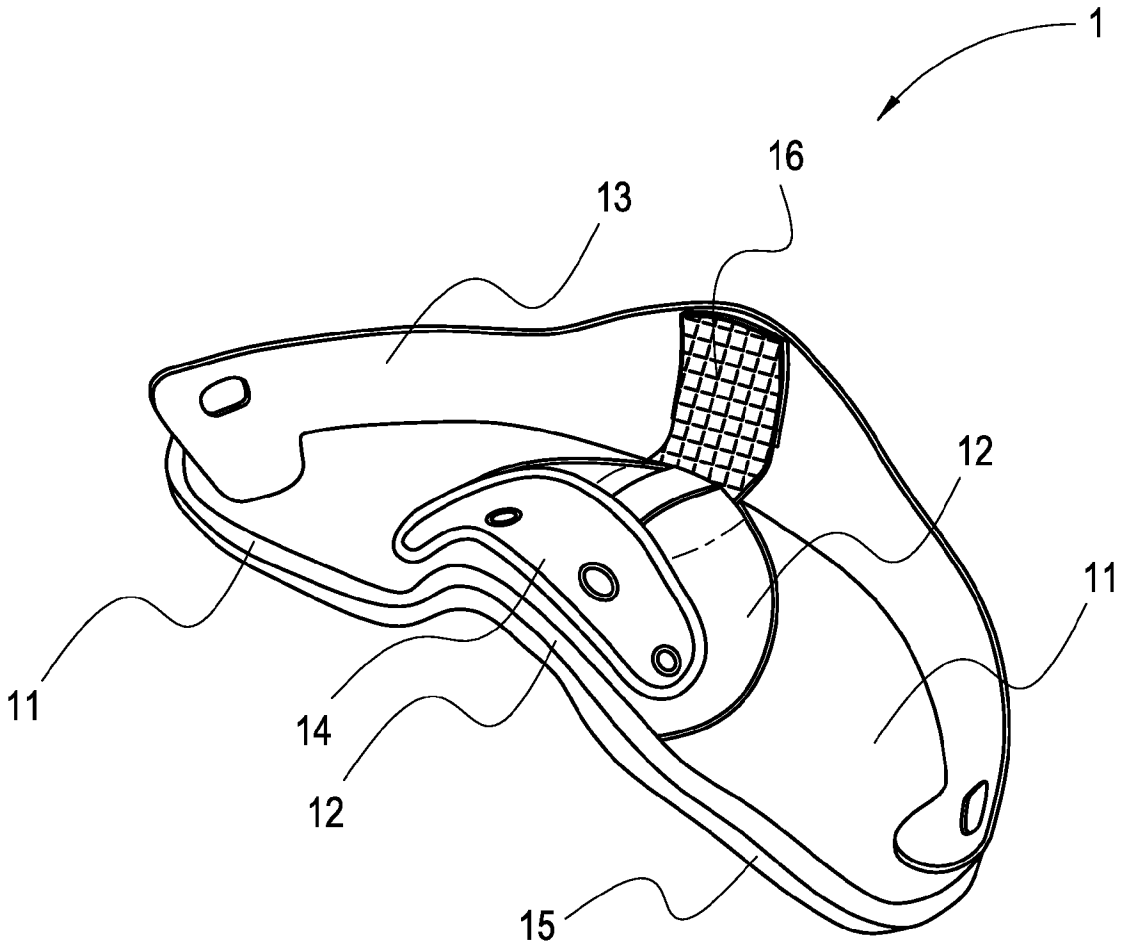
FIG. 1 illustrates a schematic structural view of a prior anti-fogging device with snow helmet.
Figure 2A:
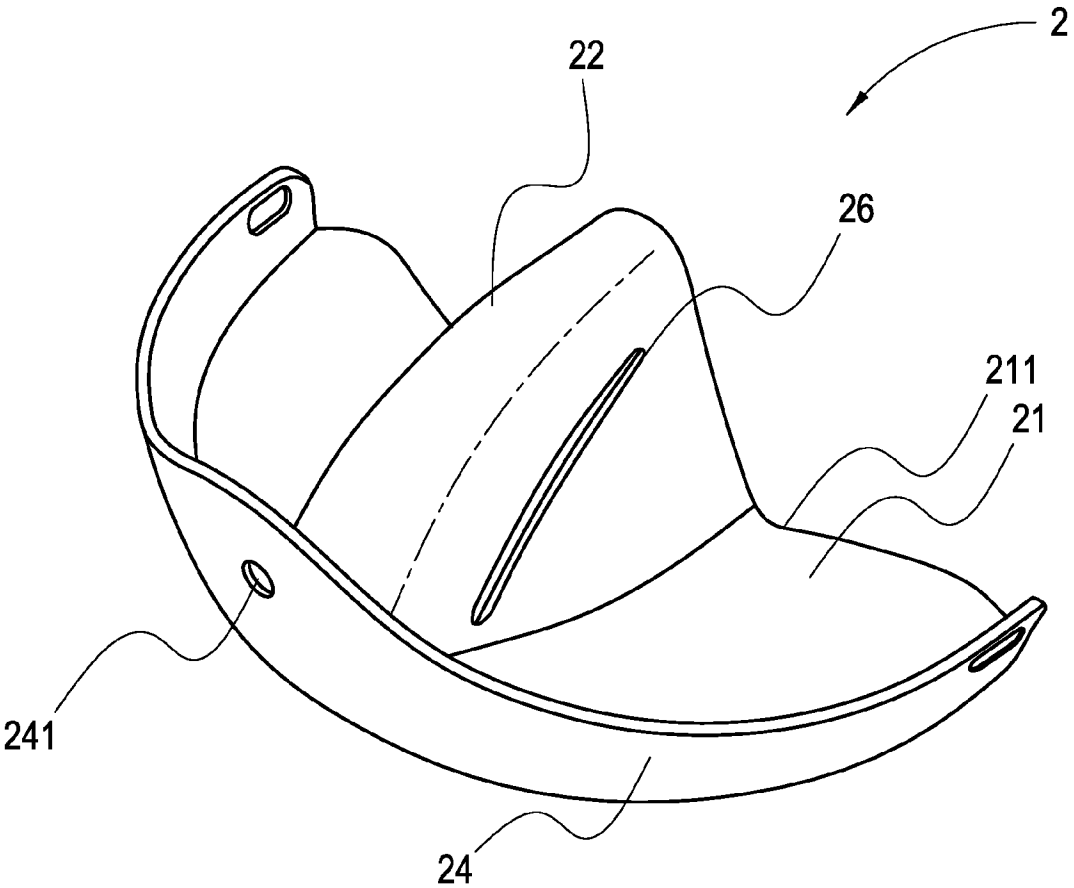
FIG. 2A and FIG. 2B illustrate two schematic 3-D views of the nose-shielding device for helmet of the present invention.
Figure 2B:
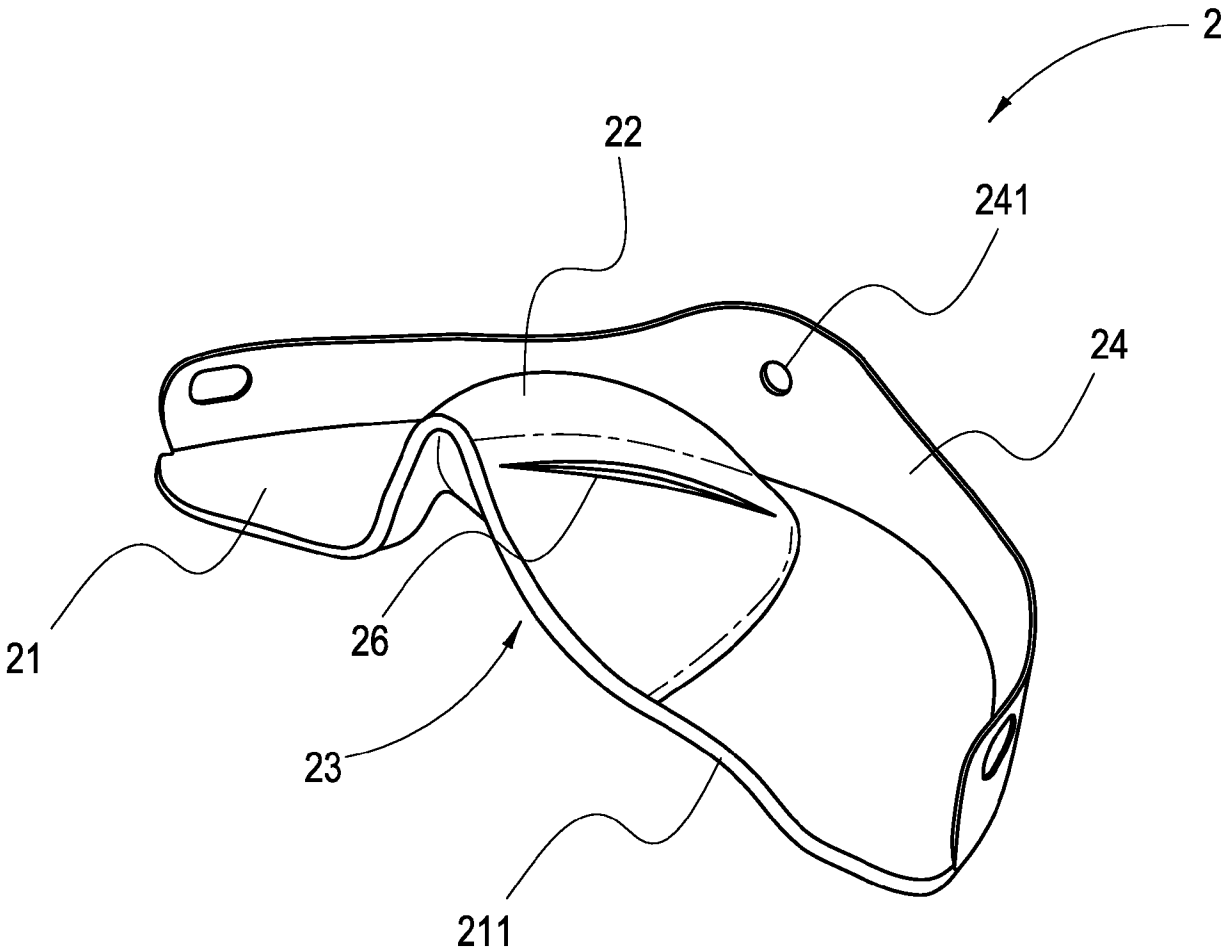
Figure 3:
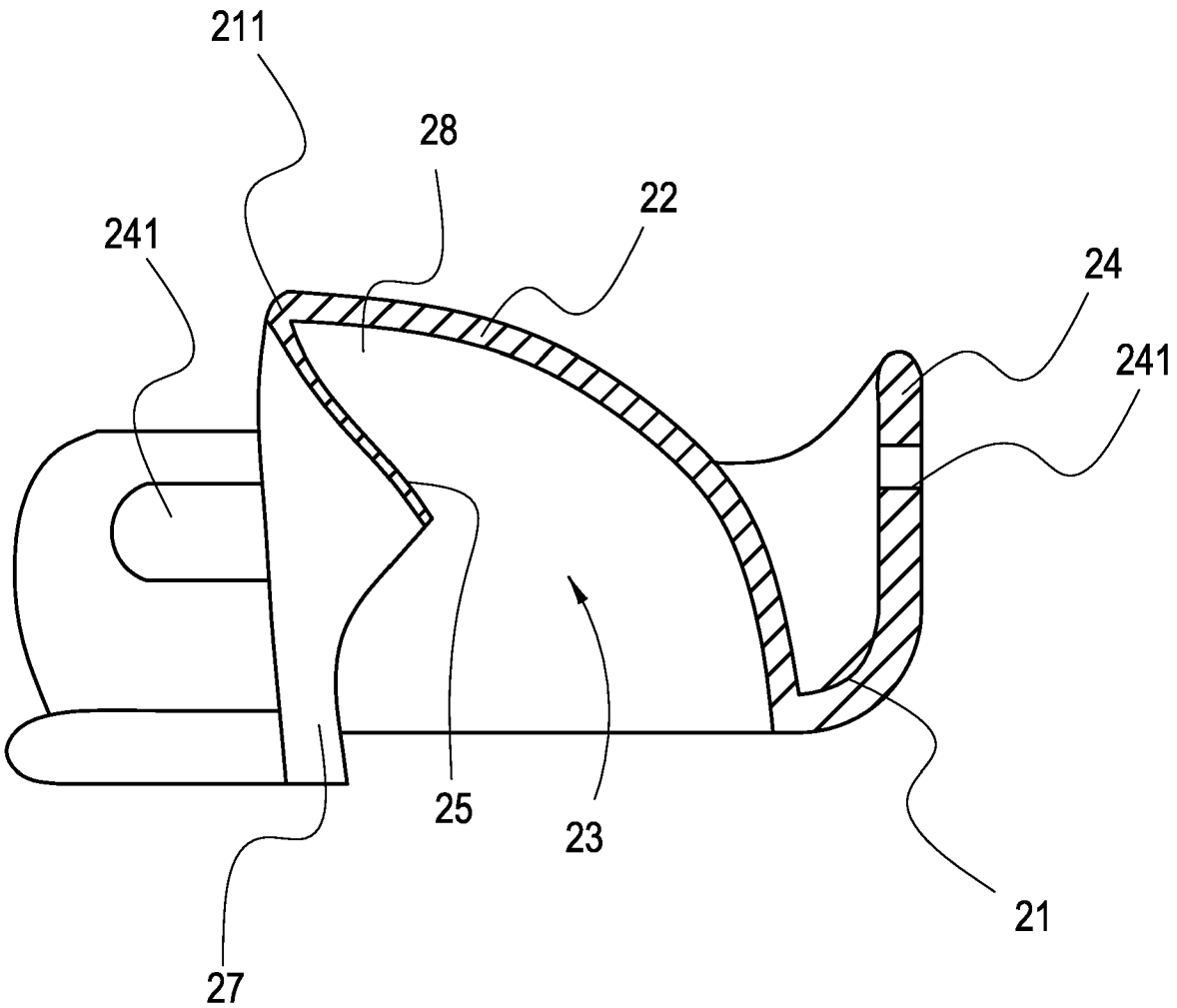
FIG. 3 illustrates a schematic sectional view of the nose-shielding device for helmet of the present invention.
Figure 4:
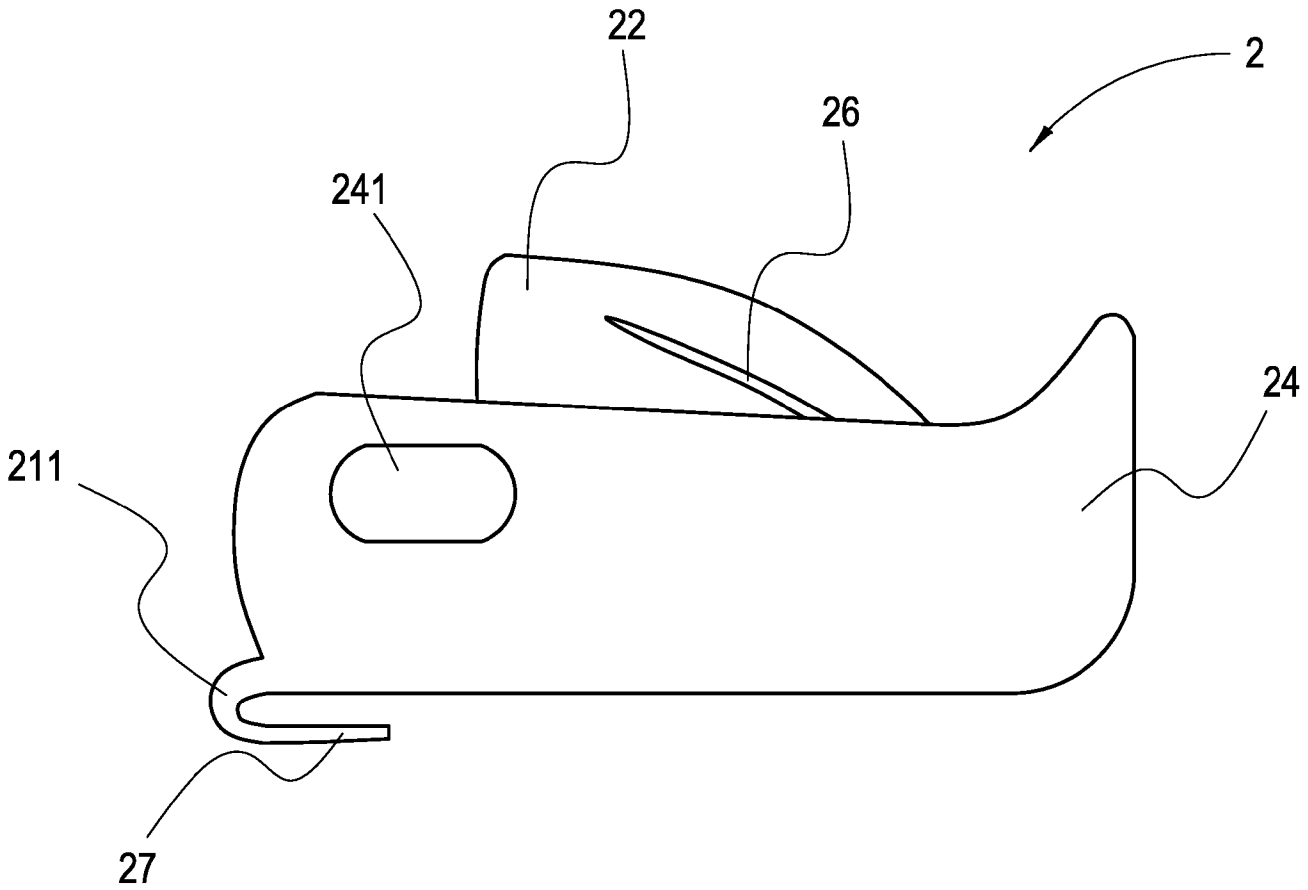
FIG. 4 illustrates schematic a lateral view of the nose-shielding device for helmet of the present invention.

Following preferred embodiments and figures will be described in detail so as to achieve aforesaid objects.

With references to FIG. 2A, FIG. 2B, FIG. 3, and FIG. 4, which illustrate two schematic 3-D views of the nose-shielding device for helmet of the present invention, a schematic sectional view of the nose-shielding device for helmet of the present invention and a schematic lateral view of the nose-shielding device for helmet of the present invention. The nose-shielding device including:

a nose-shielding body 2, which has a nose-shielding surface 21 and a positioning surface 24 that are about perpendicular to each other, a nose-shielding portion 22 being located around the central of the nose-shielding surface 21 and protruded upward, a nose-shielding room 23 being formed accordingly inside the nose-shielding portion 22, wherein the other side edge, without the positioning surface 24, of the nose-shielding surface 21 is elongated backward and bent inwardly to form a fold sheet 27, the fold sheet 27 covers the nose-shielding portion 22, so that the bottom surface of the nose-shielding portion 22 is formed a nose-touching portion 25, the nose-touching portion 25 cannot fit the bottom surface of the nose-shielding portion 22 since the nose-shielding portion 22 is a streamline arc surface, thus a distance is between the nose-touching portion 25 and the bottom surface of the nose-shielding portion 22, an adjusting room 28 is formed between the nose-touching portion 25 and the bottom surface of the nose-shielding portion 22, the nose-touching portion 25 has the feature of adjustment in order to fit every operator no matter what the figure of the nose of the operator is, and the positioning surface 24 has at least one positioning hole 241.

Preferably, the nose-shielding surface 21 and the positioning surface 24 are semi-arc surfaces.

Preferably, the side surface of the nose-shielding portion 22 is a streamline arc surface that is similar to the figure of a nose in order to fit the bridge of the nose of an operator.

Preferably, the each side surface of the nose-shielding portion 22 has a groove 26 in order to fit the each nosewing of the nose of an operator.

Preferably, the nose-shielding body 2 is made integrally.

Preferably, the nose-shielding 2 is made of rubber and plastic material, and the rubber and plastic material is selected from the group consisted of PU and silicone.

Figure 5:
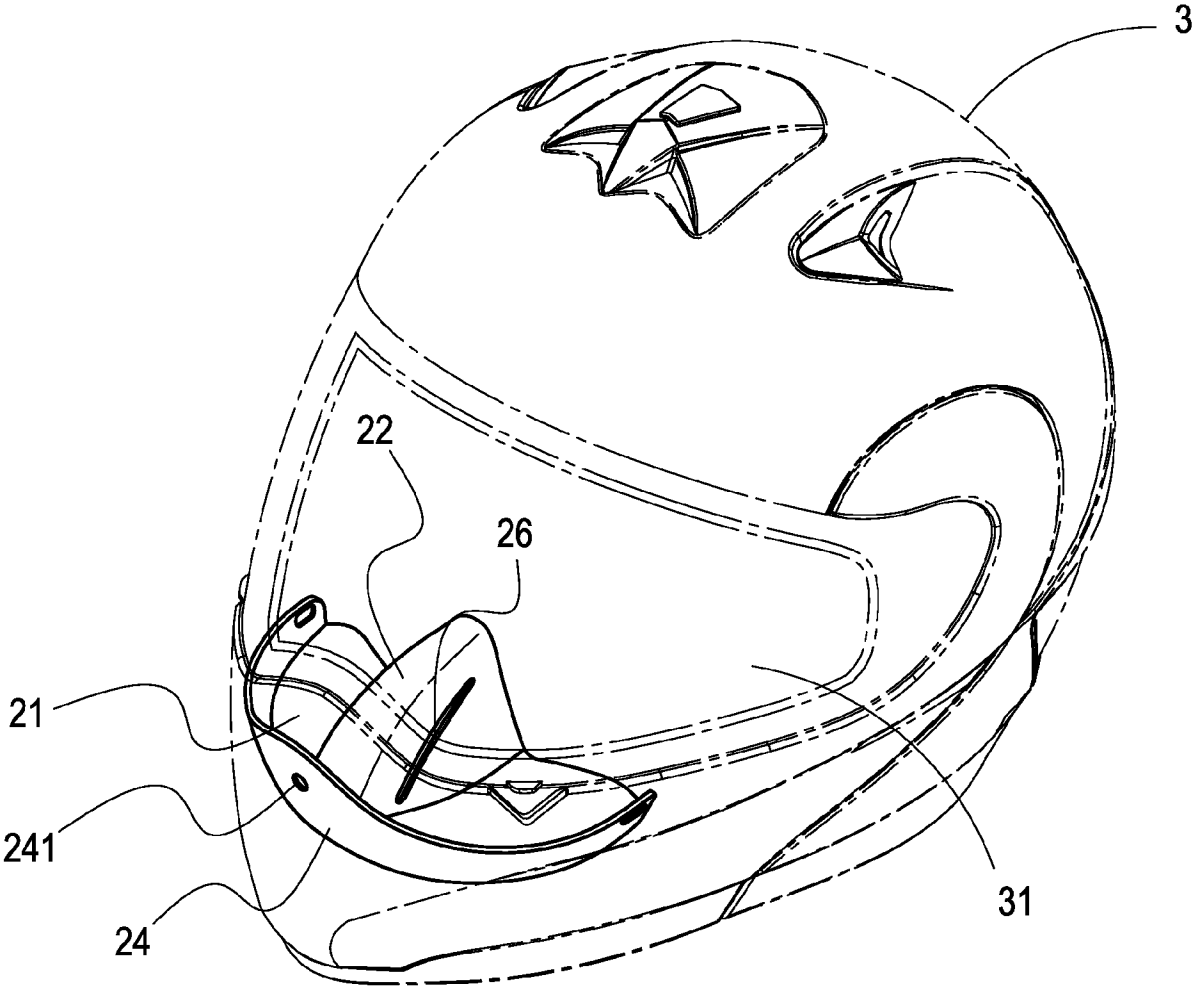
FIG. 5 illustrates a schematic combining view of the nose-shielding device and the helmet of the present invention.
Figure 6:
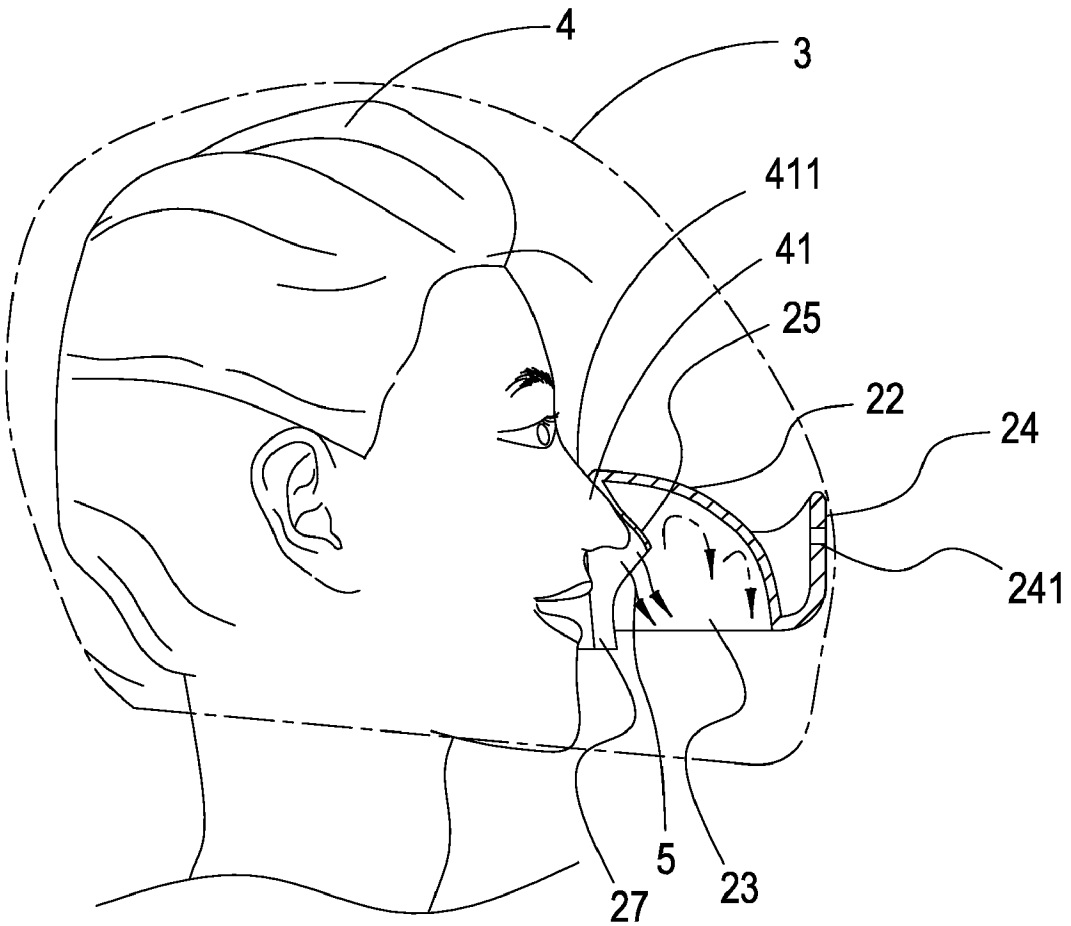
FIG. 6 illustrates a schematic application view of the nose-shielding device and the helmet of the present invention.

With references to FIG. 5 and FIG. 6, which illustrate a schematic combining view of the nose-shielding device and the helmet of the present invention and a schematic application view of the nose-shielding device and the helmet of the present invention. As shown in figures, the positioning surface 24 has at least one positioning hole 241 so as to fix the positioning surface 24 of the nose-shielding body 2 onto the inner side surfaces of the helmet 3, and thus the nose-shielding body 2 is tightly adhered to the internal of the helmet 3 and located below a mask 31.

According to FIG. 6, while an operator 4 wears the helmet 3, the face of the operator 4 touches the side edge 212 of the nose-shielding body 2, and the nose 41 is accommodated in the nose-shielding room 23, further that the bridge 411 of the nose 41 of the operator 4 fits the nose-touching portion 25. Due to the feature of adjustment, the touched position of the bridge 411 of the nose 41 of the operator 4 and the nose-touching portion 25 is completely sealed. When warm air 5 is discharged from the nose of the operator 4, the nose-shielding surface 21, the nose-shielding portion 22 and the nose-touching portion 25 may block the upwardly moving warm air, so that the warm air 5 only goes down to avoid that the mask 31 of the helmet 3 is nebulized.

With the comparison to prior arts, the nose-shielding device for helmet has following advantages listed below:

1. The present invention is made integrally, therefore the complicate manufacturing processes of the helmet product with anti-fogging can be overcome.
2. The present invention adopts a single type of material in order to a uniform production process, and cost, time and labor can then be saved, and other quality problems caused by the complicate manufacturing processes are reduced as well.
3. The present invention is made of rubber and plastic material. Hence, the position of the nose-touching portion touching the bridge is completely sealed, so that the warm air discharged from the nose or mouth of the operator may not go up to the portions above the nose of the operator, and the mask of the helmet is not nebulized.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A nose-shielding device for helmet comprising:

a nose-shielding body, which has a nose-shielding surface and a positioning surface that are about perpendicular to each other;

the positioning surface of the nose-shielding body has at least one positioning hole in order to let the nose-shielding body be combined inside the helmet and located below a mask;

a nose-shielding portion being located around the central of the nose-shielding surface and protruded upward;

a nose-shielding room being formed accordingly inside the nose-shielding portion;

a nose-touching portion being formed at the bottom surface of the nose-shielding portion; and an adjusting room being formed between the nose-touching portion and the bottom surface of the nose-shielding portion.

2. The nose-shielding device for helmet according to claim 1, wherein the side surface of the nose-shielding portion is a streamline arc surface that is similar to the figure of a nose in order to fit the bridge of the nose of an operator.

3. The nose-shielding device for helmet according to claim 1, wherein the nose-shielding body is made integrally.

4. The nose-shielding device for helmet according to claim 1, wherein the each side surface of the nose-shielding portion has a groove in order to fit the each nosewing of the nose of an operator.

5. The nose-shielding device for helmet according to claim 1, wherein the other side edge, without the positioning surface, of the nose-shielding surface is elongated backward and bent inwardly to form a fold sheet, the fold sheet covers the nose-shielding portion, so that the bottom surface of the nose-shielding portion is formed the nose-touching portion.

6. The nose-shielding device for helmet according to claim 1, wherein the nose-shielding is made of rubber and plastic material.

7. The nose-shielding device for helmet according to claim 6, wherein the rubber and plastic material is selected from the group consisted of PU and silicone.

* * * * *